US006684775B2

(12) United States Patent
Dufour et al.

(10) Patent No.: US 6,684,775 B2
(45) Date of Patent: Feb. 3, 2004

(54) PRINTING UNIT WITH ROLL-AWAY INKERS

(75) Inventors: Charles Henry Dufour, Durham, NH (US); Charles Reif Hammond, Durham, NH (US); John Thomas Lorrey, Kittery Point, ME (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 4 days.

(21) Appl. No.: 09/876,764

(22) Filed: Jun. 7, 2001

(65) Prior Publication Data

US 2002/0185025 A1 Dec. 12, 2002

(51) Int. Cl.[7] ..... B41F 5/00; B41F 31/00; B41F 15/14; B41F 49/00; B41F 5/16; B41K 1/48; B41L 27/18

(52) U.S. Cl. ..... 101/216; 101/480; 101/335

(58) Field of Search ..... 101/178–181, 101/219–221, 477, 479, 480, 335

(56) References Cited

U.S. PATENT DOCUMENTS 4,480,543 A * 11/1984 Hechler ..... 101/152
5,025,726 A 6/1991 Funabashi et al. ..... 101/352
5,385,093 A * 1/1995 Rogge et al. ..... 101/247
5,640,906 A 6/1997 Schmitt ..... 101/177
2001/0037743 A1 * 11/2001 Takahashi ..... 101/477
2002/0005133 A1 * 1/2002 Detmers et al. ..... 101/480
2002/0066379 A1 * 6/2002 Douillard et al. ..... 101/220

FOREIGN PATENT DOCUMENTS

DE 10013452 10/2000

* cited by examiner

*Primary Examiner*—Stephen D. Meier
*Assistant Examiner*—Michael S. Brooke
(74) *Attorney, Agent, or Firm*—Davidson, Davidson & Kappel, LLC

(57) ABSTRACT

A printing unit includes a plate cylinder, a blanket cylinder for printing a first side of a web of material, and an inker for inking the plate cylinder, the inker being movable between an active position and an inactive position, the inker contacting the plate cylinder in the active position and the inker being separated from the plate cylinder in the inactive position. A plate operation unit such as a direct imaging device or a plate exchanger is movable into the active position of the inker when the inker is in the inactive position.

24 Claims, 3 Drawing Sheets

PRINTING UNIT WITH ROLL-AWAY INKERS

BACKGROUND OF THE INVENTION

The present invention relates generally to printing presses and more specifically to a printing unit with a roll-away inking unit.

U.S. Pat. No. 5,025,726 discloses a movable inker type printing machine in which an inker for a satellite printing press is automatically detachable to the press when in a clutch-off position, and automatically connects itself to the press when a clutch-on instruction is received. The plate cylinders of the printing press are plated in a conventional manner.

U.S. Pat. No. 5,640,906 discloses a short multi-color web-fed rotary printing press utilizing a vertical stack of bridge printing units which are supported by horizontally shiftable frame sections. Inking units move with their respective printing cylinders on a common frame.

BRIEF SUMMARY OF THE INVENTION

An object of the present invention is to provide a printing unit in which the plate cylinder can be easily imaged with a minimum of space requirements. Another alternate or additional object of the present invention is to provide for easy imaging of a vertical stack printing unit.

The present invention thus provides a printing unit having a plate cylinder, a blanket cylinder for printing a first side of a web of material, and an inker for inking the plate cylinder, the inker being movable between an active position and an inactive position, the inker contacting the plate cylinder in the active position and the inker being separated from the plate cylinder in the inactive position. A plate operation unit is movable into the active position of the inker when the inker is in the inactive position.

The plate operation unit, which may be for example an imaging device or an automatic plate exchanger, may then perform an operation on the plate cylinder while the inker is in the inactive position. When in use in a vertical stack or other configuration, the amount of space about the plate cylinder for inking and plating can be reduced, as the same area on the plate cylinder is used for both functions.

"Plate cylinder" as defined herein includes any imaging unit, and may include plate cylinders with attachable flat or sleeve-shaped plates, and may also include directly imagable cylinders. When the plate cylinder is used with flat plates, the plate operation unit preferably is an automatic plating mechanism, and when the plate cylinder is directly imagable, the plate operation unit preferable is an imaging device, which may include for example a laser for imaging the plate cylinder.

The inker preferably includes a plurality of inker rolls, and may be moved on a carriage in a manner similar to that disclosed in U.S. Pat. No. 5,025,726, which is hereby incorporated be reference herein.

The plate cylinder and blanket cylinder preferably are mounted rotatably to a center frame section, and the inker is mounted to a first frame section movable with respect to the center frame section.

Preferably, the printing unit further includes a second plate cylinder, a second blanket cylinder for printing a second side of the web, a second inker for inking the second plate cylinder, the second inker being movable between a second active position and a second inactive position, the second inker contacting the second plate cylinder in the second active position and the second inker being separated from the second plate cylinder in the second inactive position. A second plate operation unit is movable into the second active position of the second inker when the second inker is in the second inactive position.

The plate cylinder, blanket cylinder, second plate cylinder and second blanket cylinder all may be supported rotatably on a center frame section, and the second inker may be supported on a second frame section movable with respect to the center frame section.

Preferably, the inker has inker rollers, at least one of which contacts the plate cylinder when the inker is in the active position. The second inker also preferably has second inker rollers at least one of which contacts the second plate cylinder when the second inker is in the active position.

A dampening unit for the plate cylinder may be connected to the center frame section, as may be a second dampening unit for the second plate cylinder may also be connected to the center frame. Alternately, the dampening units may be connected to the movable first or second frame sections and thus be considered to define part of the respective active position together with their respective inking units.

An overhead hoist may be provided to assist in the removal of cylinders or rollers.

Preferably, the plate cylinder and the second plate cylinder are in a similar horizontal plane.

The plate cylinder and the blanket cylinder may be driven by a common drive motor or by two individual drive motors. Further, the blanket cylinder and the second blanket cylinder may be driven by a common drive motor and each of the plate cylinder and the second plate cylinder by an individual drive motor. The motors may be driven by one of the drive motors of the plate cylinders or the blanket cylinders. It is also possible to drive the inkers by at least one individual drive motor.

Preferably, a roll-away mechanism for the movable side frame, I.e. the first frame section and the second frame section, is provided, e.g. a motor-driven mechanism with a rail system supporting the movable sections. Moreover, a linear motor can be used to roll away the movable sections.

The blanket cylinder may act with the second blanket cylinder to print the web from both sides or may with an impression cylinder to print the web from only one side.

The present invention also provides a method for performing an operation on a plate cylinder comprising the steps of:

- inking the plate cylinder with an inking unit at a first circumferential location of the plate cylinder;
- moving the inking unit out of contact with the plate cylinder; and
- moving a plate operation unit to operate on the plate cylinder at the first circumferential location.

BRIEF DESCRIPTION OF THE DRAWINGS

The present invention is described below by reference to the following drawings, in which.

DETAILED DESCRIPTION

Figure 1:
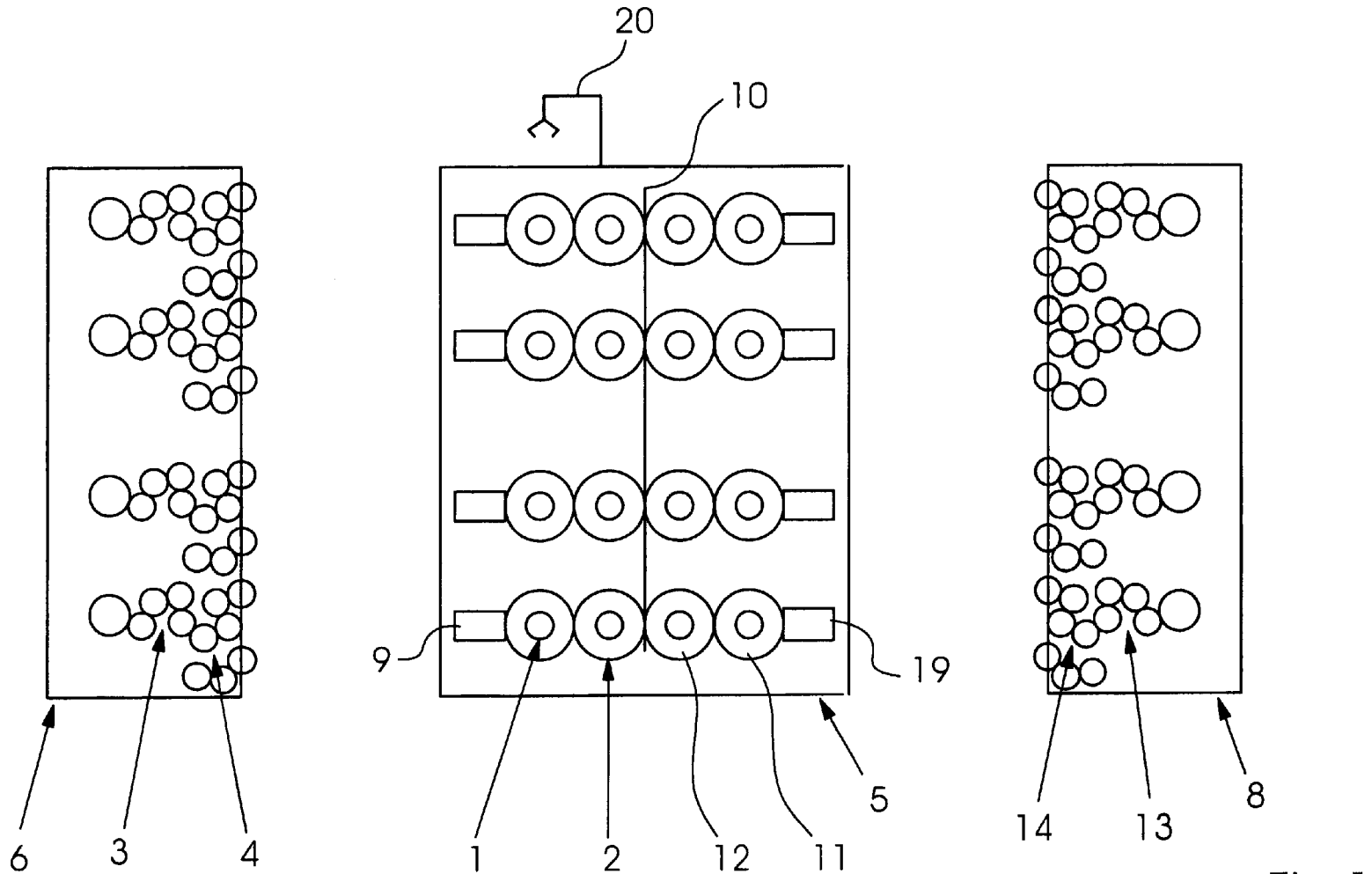
FIG. 1 shows a side view of a web printing press with printing units according to the present invention.

FIG. 1 shows a side view of a four print-unit web offset lithographic printing press, each print unit being a preferred embodiment according to the present invention. Each print unit has a first plate cylinder 1, which may include a gap for at least one lithographic offset printing plate, although a tubular plate or direct imaging are possible. A first blanket cylinder 2 may have an axially-removable or flat blanket attached thereto. A second blanket cylinder 12 forms a nip with first blanket cylinder 2, through which nip a web 10 passes. A second plate cylinder 11 is provided to image the second blanket cylinder 12.

Blanket cylinders 2, 12 and plate cylinders 1, 11 are supported rotatable in a central frame section 5. A hoist 20 may be provided to aid in removing one or more of the cylinders 1, 2, 11, 12.

Moveable with respect to central frame section 5 are a first frame section 6 and a second frame section 8, which support inking units 4 and 14 respectively. Inking unit 4 has ink rollers 3 and inks plate cylinder 1 when at least one of rollers 3 contacts plate cylinder 1, which is accomplished by moving first frame section 6 toward central frame section 5 so that an active position of inking unit 4 is defined. Inking unit 14 has ink rollers 13 for similarly inking plate cylinder 11.

FIG. 1 shows the inking units 4, 14 in an inactive position. In this position, plate operation unit 9, which in this exemplary example is an automatic plate changing device, is located in the active position of the inking unit 4. A flat printing plate on the plate cylinder 1 thus may be replaced. Plate operation unit 19 may be for example a laser imaging device for writing an image on plate cylinder 11, which may be a directly imageable plate cylinder. Typically however, plate operation units 9 and 19 will be similar devices, for example both laser imaging devices. Further, the space between the rolled away first frame section 6 and the central frame section allows the press operator to have easy access both to the plate cylinder 1 and to the inking unit, e.g. for maintenance work or replacement of cylinders or rollers. This work can be assisted by hoist 20.

Figure 2:
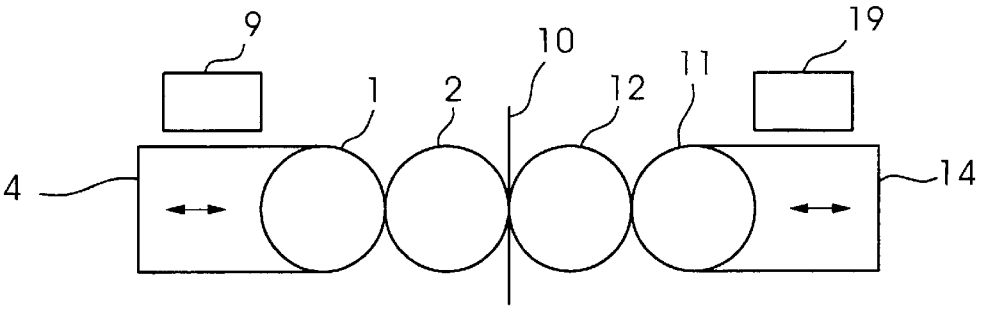
FIGS. 2, 3, 4, 5 and 6 show a side view of a printing unit according to the present invention with the inking units in both active and inactive positions, and the movement of the inking units therebetween.

FIG. 2 shows the inkers 4 and 14 contacting their respective plate cylinders 1 and 11. Dampening units 30, 32 (FIG. 5) may be provided for each plate cylinder 1, 11, and may be connected to the center frame section 5 (FIG. 1) or the movable side sections 6, 8.

In the position shown in FIG. 2, images on plate cylinders 1 and 11 are transferred, respectively, to blanket cylinders 2, 12 and then to opposing sides of web 10. The inkers 4 and 14 thus are in an active position, and plate operation units 9, 19 are located apart from plate cylinders 1 and 11. Plate operation units 9, 19 for example may be supported on central frame section 5, and may be located to above, below or laterally apart from the inkers 4, 14 so as to be inactive. The units 9, 19 thus advantageously may be stored in their inactive state where space is available, and need not be located directly near the respective plate cylinder surface. They may be swung or linearly moved by the use of a driving unit into their respective active position, which corresponds to the active position of the respective inker 4, 14.

Figure 3:
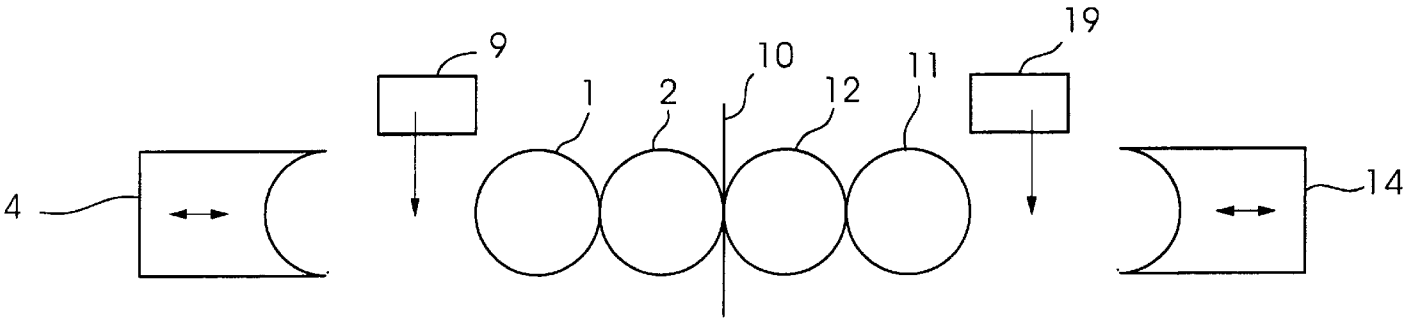
Figure 4:
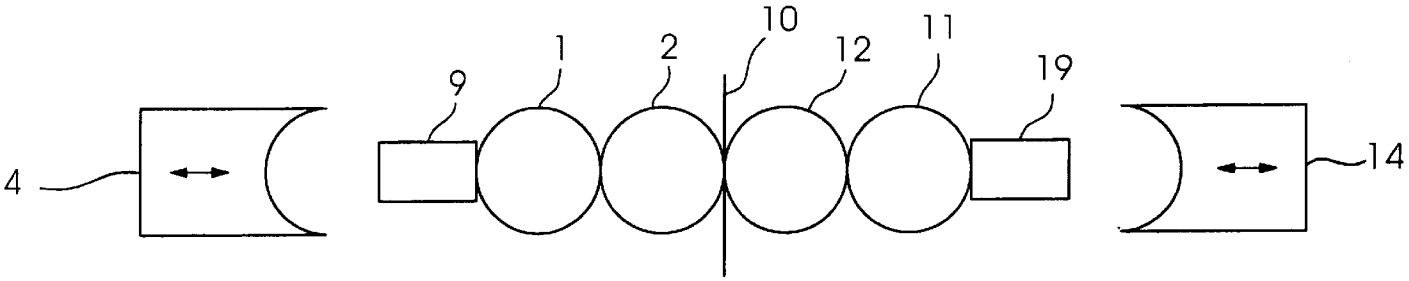

As shown in FIGS. 3 and 4, the inkers 4, 14 may then be moved away from their respective plate cylinder 1, 11 to an inactive position. Plate operation units 9 and 19 are then moved into the former active position of inkers 4, 14, respectively. The plate operation units 9, 19 thus can perform an operation on the plate cylinders 1, 11 at a similar circumferential location to where the inkers 4, 14 acted on the plate cylinders 1, 11. A similar circumferential location as defined herein includes a location where the operation units act on the plate cylinders 1, 11 at a location available within or nearby the space between the rolled away inkers 4, 14 and the respective plate cylinders 1, 11.

Figure 5:
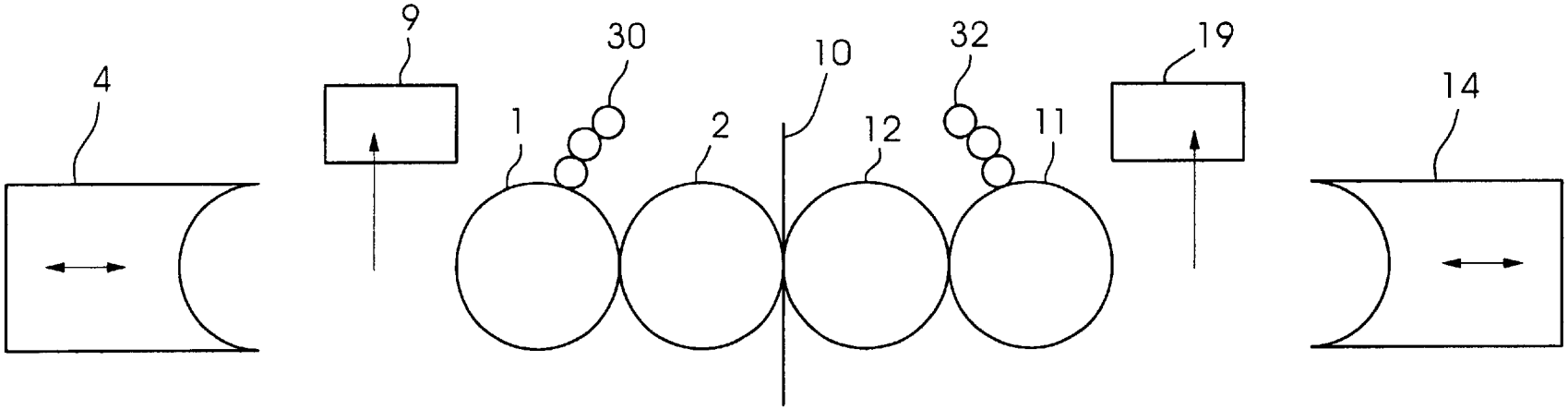
Figure 6:
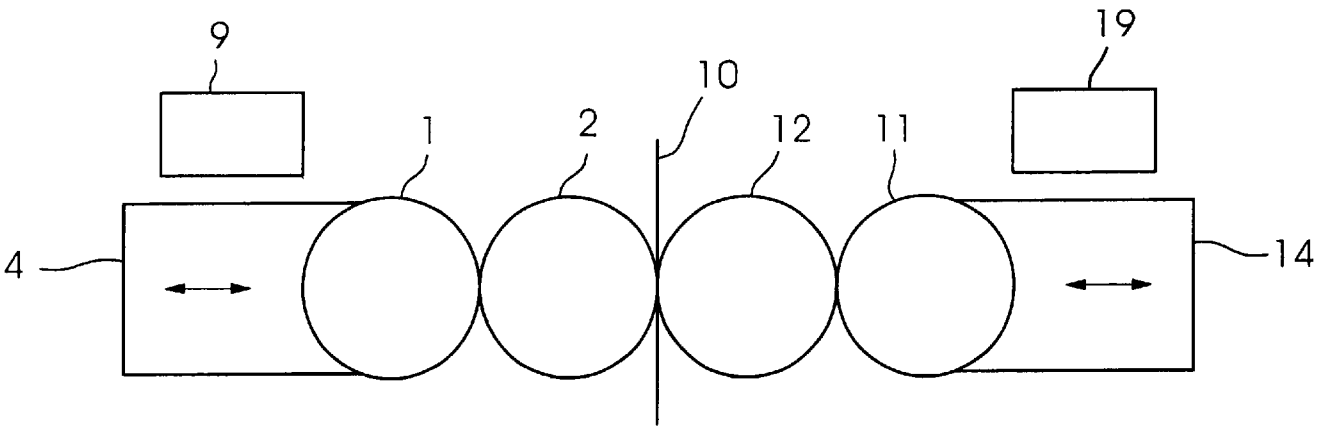

As shown in FIGS. 5 and 6, after the plate operation units 9, 19 are finished operating on plate cylinders 1, 11, respectively, for example by changing an image on the plate cylinders 1, 11, the plate operation units 9, 19 are withdrawn. The inkers 4, 14 can then be moved to their active positions, where they contact plate cylinders 1, 11 respectively.

What is claimed is:

1. A printing unit comprising:

a plate cylinder;

a blanket cylinder for printing a first side of a web of material;

an inker for inking the plate cylinder, the inker being movable between an active position and an inactive position, the inker contacting the plate cylinder in the active position and the inker being separated from the plate cylinder in the inactive position so that the plate cylinder is separated from all inkers associated with the plate cylinder; and a plate operation unit movable into the active position of the inker when the inker is in the inactive position.

2. The printing unit as recited in claim 1 wherein the plate operation unit is an automatic plate exchanger.

3. The printing unit as recited in claim 1 wherein the plate operation unit is an a direct imaging device.

4. The printing unit as recited in claim 3 wherein the plate cylinder and the second plate cylinder define a horizontal plane.

5. The printing unit as recited in claim 1 wherein the inker includes a plurality of rotatable inker rollers.

6. The printing unit as recited in claim 5 wherein at least one of the inker rollers contacts the plate cylinder in the active position.

7. The printing unit as recited in claim 1 further comprising a center frame section and a first frame section movable with respect to the center frame section, the plate cylinder and the blanket cylinder supported rotatably to the center frame section, and the inker mounted to the first frame section.

8. The printing unit as recited in claim 1 further comprising a second plate cylinder; a second blanket cylinder for printing a second side of the web; a second inker for inking the second plate cylinder, the second inker being movable between a second active position and a second inactive position, the second inker contacting the second plate cylinder in the second active position and the second inker being separated from the second plate cylinder in the second inactive position; and a second plate operation unit movable into the second active position of the second inker when the second inker is in the second inactive position.

9. The printing unit as recited in claim 8 further comprising a center frame section and a first and a second frame section movable with respect to the center frame section, the plate cylinder, blanket cylinder, second plate cylinder and second blanket cylinder supported rotatably on center frame section, the inker supported on the first frame section and the second inker supported on the second frame section.

10. The printing unit as recited in claim 8 wherein the first and second inkers each include rotatable inker rollers.

11. The printing unit as recited in claim 8 further comprising a dampening unit for the first plate cylinder and a second dampening unit for the second plate cylinder.

12. The printing unit as recited in claim 1 further comprising a dampening unit for the plate cylinder.

13. The printing unit as recited in claim 1 further comprising at least one overhead hoist for assisting removal of at least one of a cylinder and a roller.

14. The printing unit as recited in claim 1 wherein the plate operation unit moves in a direction parallel to the first web.

15. A method for performing an operation on a plate cylinder comprising the steps of:

inking the plate cylinder with an inking unit at a first circumferential location of the plate cylinder;

moving the inking unit out of contact with the plate cylinder so that the plate cylinder is separated from all inking units associated with the plate cylinder; and moving a plate operation unit adjacent the plate cylinder at the first circumferential location; and performing a plate operation on the plate cylinder using the plate operation unit.

16. The method as recited in claim 15 wherein the plate operation unit is a direct imaging unit.

17. The method as recited in claim 15 wherein the plate operation unit is a plate exchanger.

18. The method as recited in claim 15 wherein the plate operation unit moves in a direction parallel to the first web.

19. A vertically-stacked printing press comprising:

a first printing unit including a plate cylinder, a blanket cylinder for printing a first side of a web of material, an inker for inking the plate cylinder, the inker being movable between an active position and an inactive position, the inker contacting the plate cylinder in the active position and the inker being separated from the plate cylinder in the inactive position so that the plate cylinder is separated from all inkers associated with the plate cylinder, and a plate operation unit movable into the active position of the inker when the inker is in the inactive position; and a second printing unit located above the first printing unit including a second plate cylinder, a second blanket cylinder for printing the first side of the web of material, a second inker for inking the second plate cylinder, the second inker being movable between a second active position and a second inactive position, the second inker contacting the second plate cylinder in the active position and the second inker being separated from the second plate cylinder in the second inactive position, and a second plate operation unit movable into the second active position of the second inker when the second inker is in the second inactive position.

20. The printing press as recited in claim 19 further comprising a central frame section, the plate cylinder and the second plate cylinder being supported by the central frame.

21. The printing press as recited in claim 20 further comprising a first frame section movable with respect to the central frame section, the inker and the second inker being supported on the first frame section.

22. The vertically stacked printing press as recited in claim 19 wherein the plate operation unit moves in a direction parallel to the first web.

23. A method for performing an operation on a plate cylinder comprising the steps of:

inking the plate cylinder with at least one inking unit at a first circumferential location of the plate cylinder;

moving all inking units associated with the plate cylinder of the at least one inking unit out of contact with the plate cylinder; and moving a plate operation unit adjacent the plate cylinder at the first circumferential location; and performing a plate operation on the plate cylinder using the plate operation unit.

24. A printing unit comprising:

a plate cylinder;

a blanket cylinder for printing a first side of a web of material;

at least one inker for inking the plate cylinder, all inkers of the at least one inker being movable between an active position and an inactive position, all inkers associated with the plate cylinder of the at least one inker contacting the plate cylinder in the active position and all inkers associated with the plate cylinder of the at least one inker being separated from the plate cylinder in the inactive position; and a plate operation unit movable into the active position of the at least one inker when all inkers of the at least one inker are in the inactive position.

* * * * *